United States Patent [19]

Brosenius

[11] 4,175,698

[45] Nov. 27, 1979

[54] METHOD AND APPARATUS FOR CONSERVATION OF ENERGY IN A HOT WATER HEATING SYSTEM

[75] Inventor: Karl H. Brosenius, Stockholm, Sweden

[73] Assignee: Tekram Associates, Inc., North Haven, Conn.

[21] Appl. No.: 954,909

[22] Filed: Oct. 26, 1978

Related U.S. Application Data

[62] Division of Ser. No. 916,855, Jun. 19, 1978, abandoned.

[30] Foreign Application Priority Data

Nov. 11, 1977 [SE] Sweden ..... 7712275

[51] Int. Cl.[2] ..... F24D 3/00; F24D 3/10

[52] U.S. Cl. ..... 237/19; 237/59; 237/61; 237/63

[58] Field of Search ..... 237/59, 61, 62, 66, 237/81, 8 C, 1 A, 8 R, 19, 63; 126/400, 362

[56] References Cited

U.S. PATENT DOCUMENTS

| | | | |
|---|---|---|---|
| 1,122,989 | 12/1914 | Newkumet | 237/19 |
| 1,294,517 | 2/1919 | Motley | 237/61 |
| 1,731,368 | 10/1929 | Baker | 237/19 |
| 2,480,883 | 9/1949 | Schramm | 237/61 |
| 2,539,469 | 1/1951 | Powers | 237/62 |
| 2,983,487 | 5/1961 | Mackey | 126/362 |
| 3,007,470 | 11/1961 | Heeger | 126/362 |
| 3,134,543 | 5/1964 | Carlson et al. | 237/63 |
| 3,202,357 | 8/1965 | Carlson | 237/61 |
| 3,341,122 | 9/1967 | Whittell, Jr. | 237/63 |
| 3,958,755 | 5/1976 | Cleer, Jr. | 237/61 |

*Primary Examiner*—Henry C. Yuen
*Attorney, Agent, or Firm*—James & Franklin

[57] ABSTRACT

A very well heat insulated water storage or accumulator tank of relatively large capacity as compared to the capacity of the hot water heating unit is interposed between the unit and the radiator system and is interconnected with the unit. Heated water from the top portion of the tank is used to preheat the unit prior to actuation thereof, and mixed water above a given temperature is fed to the unit from the tank during actuation, such that the corrosive condensation on the heating surfaces of the heating unit, caused by heating a cold surface, is eliminated thereby extending the useful life of the unit. When the unit is actuated, heated water from the unit fills the tank from the top side until a volume of non-heated return water from the radiator system, approximately equal to the capacity of the unit, remains in the bottom of the tank. After the unit is deactuated, the non-heated water in the tank is utilized to cool the unit by replacing the heated water in the unit from the bottom side with cool water, causing the heated water in the unit to flow upwards into the tank. The different operations form together a "heating cycle," which is repeated again and again and which is performed entirely automatically by an electric control circuit. Energy is thus conserved because all of the heated water is utilized and the energy normally lost from a hot unit is significantly reduced. In this manner, the average efficiency of the system is greatly improved.

14 Claims, 6 Drawing Figures

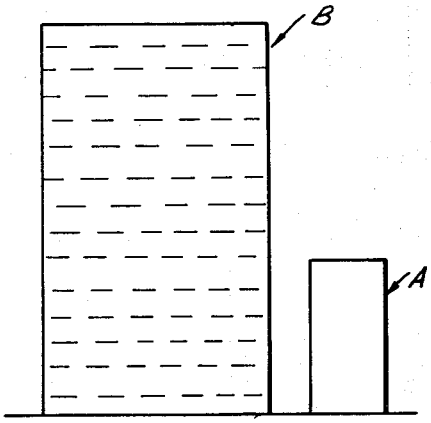
FIG. 2a
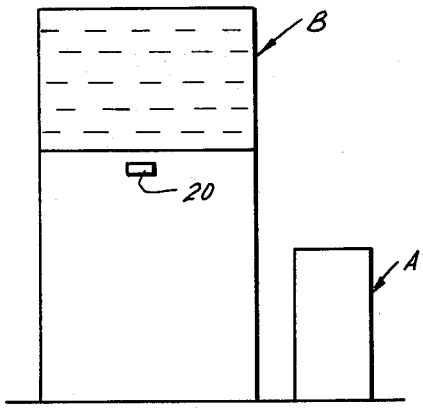
FIG. 2b
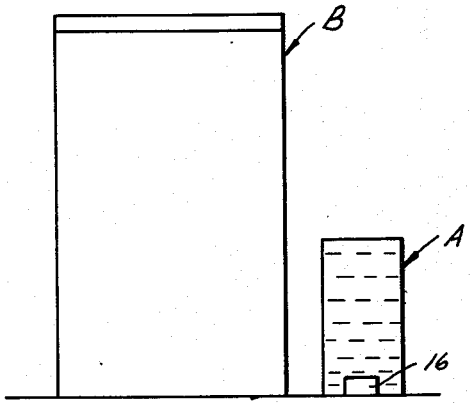
FIG. 2c
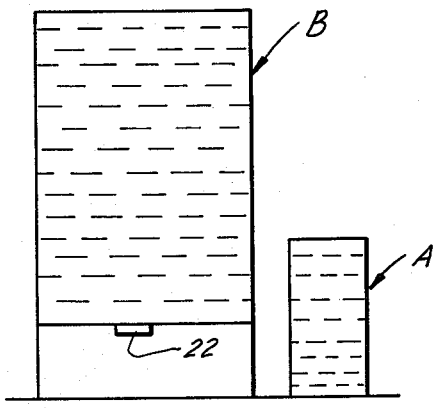
FIG. 2d
FIG. 2e
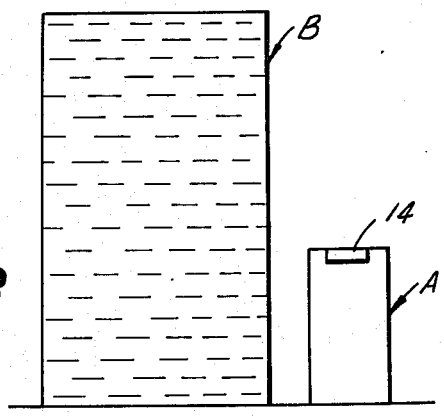

METHOD AND APPARATUS FOR CONSERVATION OF ENERGY IN A HOT WATER HEATING SYSTEM

This is a division, of application Ser. No. 916,855, filed June 19, 1978, now U.S. Pat. No. 4,155,506.

The present invention relates to hot water heating systems and, more particularly, to a hot water heating system wherein heat losses are significantly reduced such that fuel is utilized more efficiently and in which the life of the heating unit is extended.

The simplest type of hot water heating system comprises a heating unit including a water resevoir and a means for heating the water in the reservoir such as by a flame obtained from burning oil, gas, or solid fuel. The water in the unit resevoir, once heated, is distributed in a water radiator system, through the aid of a circulation pump. The heating unit is normally thermostatically controlled such that the water within the unit is maintained at a present temperature level in order to provide sufficient heated water, when required.

The water contained in the resevoir within the heating unit is normally kept at a relatively high temperature, for example, 85° C. (185° F.) the year round, such that heated water for heating the radiator system or for heating a domestic hot water heater, is available when required. However, a heating unit of this type emits large quantities of useless heat, partly through heat radiation from the unit to the surrounding air and partly because the heating unit is continuously cooled by the chimney draft such that heat is lost to the outside environment. The amount of such heat loss is relatively high, especially during times when relatively little heating demand and, thus, infrequent actuation of the unit such as during the spring, summer and autumn months.

Due to the above described heating losses, the efficiency of the system, when averaged over a significant time period such as a year, will be remarkably low. Experimental data indicates that only approximately 55%-65% of the energy content of a fuel, such as oil, will be usefully supplied to the heating system over the course of a year.

It is known that the average efficiency of such a system can be enhanced through the utilization of a well insulated heated water storage or accumulator tank, which is connected to the heating unit. When a storage or accumulator tank is utilized to feed the radiator system, the tank normally has a much larger water capacity than the unit. Thus, the heating unit need be actuated less frequently to provide the required heated water. Therefore, such a system usually is more efficient than a system without a storage tank. A system utilizing a storage tank therefore has certain advantages which compensate for the increased investment costs of the system, especially in light of the present high cost of fuel.

However, when a storage tank or accumulator is utilized in conjunction with the heating unit, the water remaining in the unit resevoir after the storage tank or accumulator has been filled with heated water is usually between 85°-90° C. (185°-194° F.). Because of the large capacity and high insulation of the storage tank, there is normally a relatively long time interval between the time when the storage tank is filled with heated water and the time when the unit must be reactuated to fill the storage tank with heated water again. During this time, the heated water remaining in the heating unit resevoir cools to room temperature, thereby generating a significant amount of lost heat. Thus, while a system including a storage tank or accumulator has a somewhat greater average efficiency than a system without a storage tank or accumulator, because heat dissipation is reduced due to the highly insulated walls of the storage tank or accumulator and infrequent unit actuation, there is still significant heat loss from the heating unit which reduces the overall efficiency of the system and therefore, requires greater fuel usage than desirable.

Further, the combination of the heating unit and storage or accumulator tank has another significant disadvantage. In conventional systems of this type, the heating unit and storage or accumulator tank are connected by two pipe connections, one connecting the bottom portion of the heating unit with the bottom portion of the storage or accumulator tank and the other connecting the top portion of the heating unit with the top portion of the storage or accumulator tank. When the heating unit is actuated, heated water flows from the top of the unit to the top of the tank, while, at the same time, the cold water from the bottom of the tank returns to the bottom of the unit to be heated. Normally, no circulating pump is required for this function because of the physical properties of fluids which, when heated, cause the lighter, heated fluid to rise to the top of a vessel and the heavier non-heated fluid to accumulate at the bottom of the vessel.

However, in this type of system, the cooler water flowing into the bottom of the heating unit from the tank tends to cool the heating surfaces of the unit to a great degree. As long as the surfaces of the heating unit adjacent to flame caused by burning fossil fuel are relatively cool, sulphur, present in the fuels, is deposited on the heating surfaces of the unit resevoir as the fuel burns. This deposited sulphur combines with condensed water to form a solution of sulfuric acid which corrodes the heating surfaces and, consequently, diminishes the useful life of the heating unit.

It is, therefore, a prime object of the present invention to provide method and apparatus for conservation of energy in a hot water heating system wherein the average efficiency of the system is greatly enhanced resulting in a significant reduction in fuel requirements.

It is another object of the present invention to provide method and apparatus for conservation of energy in a hot water heating system wherein the useful life of the heating unit is significantly extended by eliminating the formation of corrosive condensation on the heating surfaces thereof.

It is a further object of the present invention to provide method and apparatus for conservation of energy in a hot water heating system wherein the heating surfaces of the heating unit are preheated, prior to actuation of the unit, so as to eliminate the formation of corrosive acids.

It is a further object of the present invention to provide method and apparatus for conservation of energy in a hot water heating system wherein the heating unit is cooled, after deactuation thereof, and the water heated in the unit at the same time being transferred to the insulated accumulator tank and put to useful purpose.

It is a further object of the present invention to provide method and apparatus for conservation of energy in a hot water heating system wherein the cooling of the heating unit after deactuation prevents heat loss therefrom through radiation to the surrounding air and convection by the chimney draft.

It is also a further object of the present invention to provide method and apparatus for conservation of energy in a hot water heating system, wherein the various types of energy, such as obtained from oil, gas, coal, wood, electricity, solar heat, heat from heating pump, from distance heating systems, etc., can be used with high efficiency and without changing of the conservation apparatus.

In accordance with the present invention, method and apparatus is provded for conservation of energy in a hot water heating system of the type having a hot water heating unit, a heat insulated storage or accumulation tank for storing heated water and means for interconnecting the tank and the unit, the tank being a source of heated water for the radiator system and for heating the domestic hot water heater. The method comprises the steps of: actuating the heating unit to heat water therein when the water temperature in the storage or accumulation tank falls below a preset temperature level; circulating heated water from the unit to the tank and non-heated water from the tank to the unit during actuation of the unit; deactuating the heating unit when a predetermined amount of non-heated water remains in the storage or accumulator tank; and, cooling the heating unit after deactuation thereof to prevent heat loss therefrom, by replacing the heated water therein with non-heated water from the storage or accumulator tank, such that the heated water in the unit after deactuation thereof is transferred to the tank and therefore may be utilized effectively.

The method further includes preheating the heating unit which is accomplished by sensing the temperature of the water in the storage or accumulator tank at a level therein which is below a volume of water in the top portion of the tank, which volume is greater than the capacity of the heating unit. When the sensed water temperature at this level falls below a given preheat temperature, a portion of the heated water in the tank above the level at which the temperature is sensed is transferred to the heating unit to raise the temperature thereof, so as to prevent the formation of corrosive condensation on the heating surfaces of the unit when the unit is actuated.

Transfer of the heated water from the tank to the unit to perform preheating is terminated when the water temperature at the bottom of the heating unit is sensed to be above the second given preheat temperature. At this point, the heating unit is actuated to heat water which is then continuously circulated to the storage or accumulator tank.

The temperature of the water within the storage or accumulator tank is sensed at a level therein above a volume of water in the bottom portion of the tank, which volume is greater than the capacity of the heating unit. When this sensed temperature exceeds a preset temperature level, the heating unit is deactuated. The heating unit is then cooled in order to utilize the heat in the heated water therein, and to prevent heat loss through radiation and/or convection which would normally occur if a volume of heated water remained in the unit. Cooling is accomplished by pumping non-heated water from the storage tank, that is, the water situated below the sensing means which deactuates the heating unit, into the bottom of the heating unit. This causes the heated water within the heating unit above the cooled water to be transferred to the storage or accumulator tank.

In this manner, when the heating cycle is complete, all of the heated water is situated in the heat insulated storage or accumulator tank and thus all of the heat therein can be utilized, and the heating unit contains only non-heated water. Thus, virtually no heat is dissipated or lost from the heating unit after deactuation. Overall heat losses of the system are, therefore, significantly reduced and the efficiency thereof is subsequently enhanced such that less fuel is required in order to supply the necessary amount of heated water.

The apparatus required to perform the method of the present invention, is relatively simple, inexpensive and maintenance free. The heating unit is provided with first and second ports located near the top and bottom thereof; respectively. The water storage or accumulator tank is provided with a water capacity which is significantly greater than the water capacity of the heating unit. Third, fourth and fifth ports are provided in the storage or accumulator tank located near the top, bottom and at a point spaced from the bottom thereof, respectively. A first conduit is provided to connect the first and third ports, thereby connecting the top of the heating unit and the top of the storage tank. A second conduit is is provided for connection to the fifth port. A third conduit is provided for connection with the fourth port. A selection valve is connected to the second and third conduits and the second port. The valve may be actuated to connect either of the second or third conduits with the second port. Further, means are provided for connecting the tank to the radiator system.

First temperature sensing means are located in the tank at a level therein below a volume of water in the top portion of the tank, which volume is greater than the water capacity of the heating unit. The first temperature sensing means is effective to cause the valve to connect the second conduit to the second port when the water temperature sensed thereby falls below a first given level. Pump means and are effective, when actuated, to pump water either from the third port to the first port or in the opposite direction from the first port to the third port. Means are provided for actuating the pump means when a temperature below the first given temperature level is sensed by the first temperature sensing means, signalling that more heated water is required by the system. When preheating the heating unit, the pump causes the heated water in the storage tank above the level at which the first temperature sensing means is placed to be pumped into the heating unit and the non-heated water in the bottom of the heated unit to be pumped via the third conduit into the storage tank. In this manner, the heating unit is preheated prior to actuation thereof, in order to prevent the formation of corrosive acids on the heating surfaces thereof which reduce the useful life of the unit.

Second temperature sensing means are located in the heating unit in the vicinity of the second port, that is, near the bottom thereof. The second temperature sensing means is effective, when water at a temperature level above a second given temperature level is sensed thereby, to deactuate the pump means, thereafter to reverse the pump means to pump in the opposite direction to cause the valve to connect the second conduit to the second port, to actuate the heating unit to begin heating water. Thus, when the heating unit is completely filled with heated water from the storage tank, the preheat portion of the cycle is completed and the heating unit can proceed to heat water, which is thereafter continuously transferred to the storage or accumulation tank.

Third temperature sensing means are located in the tank in the vicinity of the fifth port, that is, at a point in the tank spaced from the bottom thereof above a volume of water larger than the unit capacity so as to form a non-heated water "pocket" at the bottom of the storage tank. It should be noted that this "pocket" will be filled with the coldest water of the whole heating system, that is, the "return water" from the radiator system, as will be described later. When water above a third given temperature level is sensed by the third temperature sensing means, the heating unit actuating means is deactuated. At this point, the heating unit has heated all of the water which is necessary and is thus turned off. The cooling portion of the cycle then begins.

The cooling portion of the cycle is initiated by a third temperature sensing means which causes the valve to connect the third conduit to the second port and causes the pump to reverse its direction to pump water from the fourth port to the second port, in other words, from the bottom of the storage tank to the bottom of the heating unit. In this manner, the non-heated water in the water "pocket" at the bottom of the storage tank is transferred to the heating unit to cool same from the bottom side and, at the same time, the heated water in the heating unit is transferred to the heat insulated storage tank such that the storage tank is virtually filled with heated water. Thus, the heat in the heated water which normally would remain in the heating unit and therefore be dissipated through radiation or convection can be utilized effectively in the heating system instead of being lost.

Fourth temperature sensing means are located in the heating unit in the vicinity of the first port, that is, near the top thereof. The fourth temperature sensing means is effective, when a temperature below a fourth given temperature level is sensed thereby, to deactuate the pump means and the third connecting means, thus completing the cooling portion of the heating cycle.

Auxiliary heating units may be utilized in conjunction with the heating system of the present invention. For instance, a solar heating unit can be connected between the third and fourth ports of the storage tank in order to heat the water within this tank, such that the primary heating unit may be used less frequently. In addition, electrical heating elements connected to a conventional electrical power source or to a wind actuated generator, can be placed within the tank for the same purpose.

To the accomplishment of the above and to such other objects as may hereinafter appear, the present invention relates to method and apparatus for conservation of energy in hot water heating systems as described in the present specification and set forth in the annexed claims, taken together with the accompanying drawings, wherein like numerals refer to like parts and in which:

FIGS. 2A–2E are diagrammatical representations of the storage or accumulator tank and heating unit of the present invention at various stages of the heating cycle.

Figure 1:
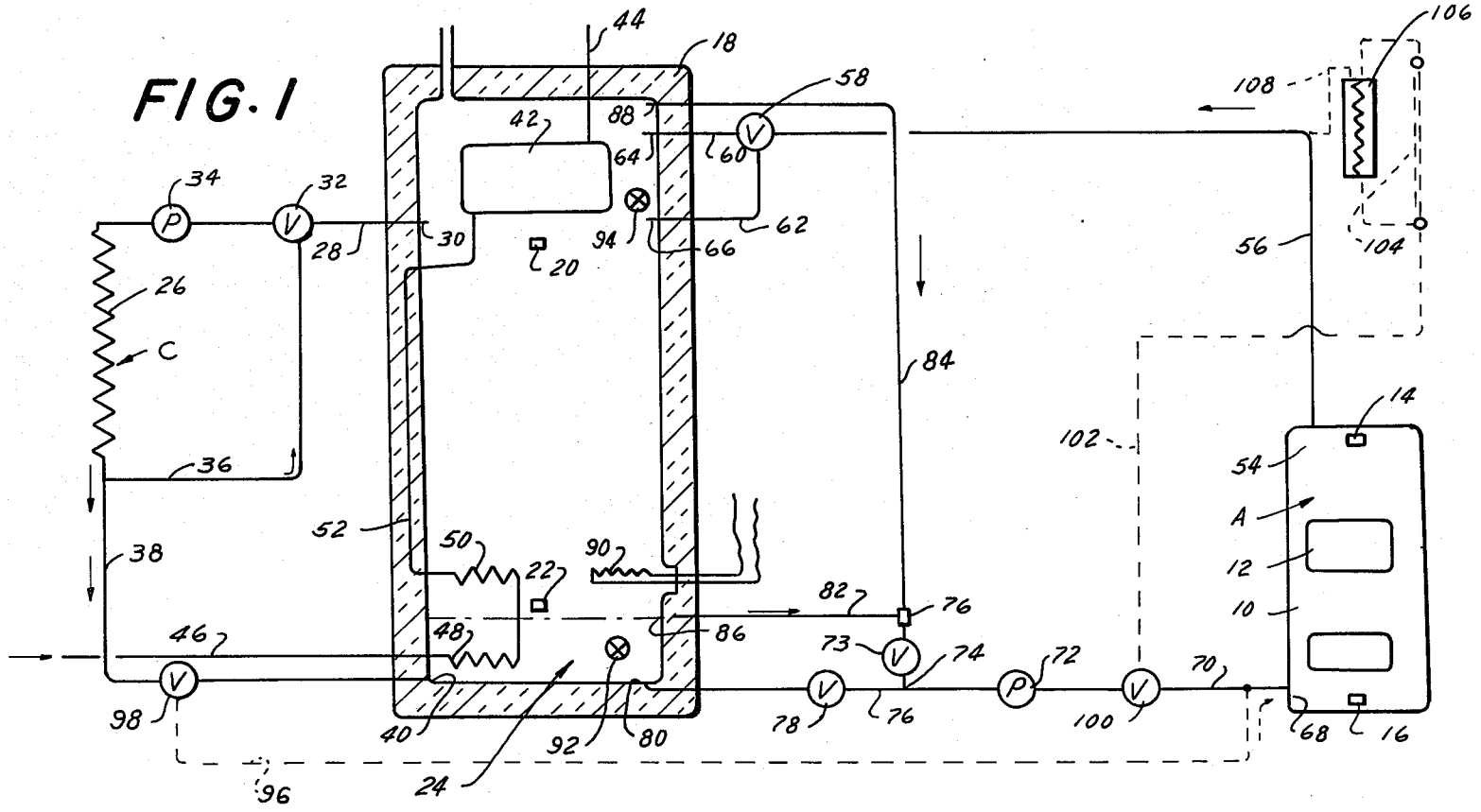
FIG. 1 is a schematic diagram of the system of the present invention.

FIG. 1 shows a schematic representation of the hot water heating system of the present invention. The heating system comprises three major elements, a heating unit, generally designated A, a storage or accumulator tank, generally designated B, and a radiator system, generally designated C, as well as the necessary connections between unit A and tank B and between tank B and system C. The heating unit A may be any one of a multitude of different commercially available water heaters or boilers, which are designed to burn fossil fuels such as oil, natural gas, coal, wood or the like. The tank B can also be heated directly, utilizing electrical or solar energy without using any heating unit A. The unit A is schematically represented on the diagram by a water resevoir 10 and a fuel burning portion 12, which is adjacent to resevoir 10 and which, when unit A is actuated, burns fuel to heat water within resevoir 10. Also included within unit A are a pair of temperature sensitive means 14, 16, preferably in the form of thermostats of conventional design, which are respectively located near the top and bottom of the resevoir 10. The electrical or thermo-hydraulic output from thermostats 14 and 16 and also form thermostats 20 and 22 are connected as inputs to a control circuit, not shown.

Storage or accumulator tank B has a water storage capacity which is significantly larger than the capacity of resevoir 10. In addition, tank B is provided with highly insulated walls 18 which reduce the amount of heat loss from tank B to the surrounding air. Located within tank B are temperature sensitive means 20, 22 which also preferably take the form of thermostats of conventional design. The electrical or thermohydraulic output of thermostats 20 and 22 are connected as inputs to the control circuit, not shown. Thermostat 20 is located at a level within tank B spaced from the top thereof, such that a volume of water greater than the capacity of resevoir 10 is situated above thermostat 20. Thermostat 22 is situated within tank B at a level therein spaced from the bottom of the tank, such that a volume of water greater than the volume of resevoir 10 is situated below thermostat 22. The volume of water situated below thermostat 22 is a non-heated water "pocket" designated as 24 on the figure. The purpose of non-heated water "pocket" 24 will become obvious as the system of the present invention is described.

It should be noted, that the "pocket" 24 can not be drained from the port 86 on the higher level, only from the bottom port 80. The water in the pocket 24 will not take part in the normal circulation between the heating unit A and the tank B during the period of actuation of the heating unit. The water pocket will therefore, during the following period of cooling the unit, contain colder water than a tank without such a pocket.

The radiator system C is shown in FIG. 1, for purposes of simplicity, as consisting of a single hot water radiator 26 of conventional design. However, it should be understood that, in reality, such a system would comprise a plurality of such radiators located throughout the building being heated. Radiator system C is connected to tank B by a conduit 28, connected to a port 30 in the wall of the tank, near the top thereof. A thermostatic shunt valve 32 and circulating pump 34 are connected in conduit 28 between port 30 and radiator 26. The outlet side of radiator 26 is split between a recirculating conduit 36 and a return conduit 38. Recirculation conduit 36 feeds the second inlet to valve 32.

Thus, radiator system C is fed from accumulator tank B through outlet port 30 which opens into conduit 28. The water in conduit 38 passes through shunt valve 32, radiator circulation pump 34 and radiator 26. A portion of the water, which has been cooled by passage through the radiator, is returned to the bottom of the accumulator tank B by means of return conduit 38 which terminates in port 40, near the bottom of tank B. The bottom portion of tank B, especially the "pocket" 24, during most of the time, will thus be filled with cooled "return water" from the radiator system 26. The remainder of the water from the outlet side of radiator 26 returns to shunt valve 32 via conduit 36 and this water is recirculated through the radiator system. Valve 32 is preferably an adjustable automatic heat sensitive shunt valve of known design utilized in a conventional manner to regulate the temperature of the water circulating in the radiator system and, thus, also regulates the quantity of heat which is furnished to the building being heated. Shunt valve 32 is preferably thermostatically controlled, the thermostat controlling same being situated in a strategic location in the building.

It is preferable to include a domestic hot water heater 42 located within the interior of tank B. Water heater 42 supplies hot water to the building, by means of outlet conduit 44, for bathing, washing, etc. Water is supplied to heater 42 through conduit 46 which is connected to a water supply, not shown. Conduit 46 can be connected to a heat exchanger consisting of coils 48 and 50, the former being located within non-heated water "pocket" 24 and the latter being above the level of same. The outlet of coil 50 is connected to conduit 52 which is connected to the inlet of heater 42.

Resevoir 10 is provided with a port 54, near the top thereof, which is connected to a conduit 56. Conduit 56 terminates in port 64 in the vicinity of the top of tank B. If the accumulator tank B is to be heated by solar heat from a solar collector 104 or a solar heat exchanger 106, conduit 56 can preferably be provided with a three-way valve 58 with a branch conduit 62, terminating in port 66 at about the same level as conduit 28 and thermostat 20. The solar heated water then enters the tank at port 66 as described later.

Resevoir 10 is provided with a second port 68, located near the bottom thereof. Port 68 is connected to a conduit 70 which, in turn, is connected to pump 72. After pump 72, conduit 70 branches into conduits 74, 76. Conduit 76 has a valve 78 therein and is connected to a port 80 located at the very bottom of tank B. Conduit 74 contains a valve 73 and is connected to a mixing valve 76, which is fed by conduits 82, 84. Conduit 82 is connected to a port 86 in tank B immediately below the level of thermostat 22 and therefore just above non-heated water "pocket" 24. Conduit 84 is connected to port 88 near the top of tank B.

FIGS. 2A through 2E represent, in a schematic fashion, the temperature distribution of the water in unit A and tank B at various portions of the heating cycle. In these figures, the shaded portions represent heated water, whereas the non-shaded portions represent non-heated water, the interface therebetween representing a temperature "front." Since FIGS. 2A through 2E show the system at various portions of the heating system, same will be utilized, in conjunction with FIG. 1, to describe the operation of the present invention.

FIG. 2A represents the temperature distribution of the water in the system at a point in time after all of the heated water is situated within tank B. For this reason, the water within heating unit A is shown as not shaded, whereas the water in tank B is shown as shaded.

The heated water within tank B is utilized by radiator system C and domestic hot water heater 42, as described above, which cools the tank water and fills the tank from below with cooled return water from the radiator system 26. Gradually the cooled water rises in the tank, and a temperature front, a "cold water front," reaches the thermostat 20, which then senses a water temperature level below a preset temperature level. This is represented in FIG. 2B by showing the temperature "front" (the interface between the shaded portion and the non-shaded portion) to be above the level of thermostat 20. When water below the preset temperature is sensed by thermostat 20, thermostat 20 generates an electrical signal to the control circuit, which initiates the preheat portion of the heating cycle. During the preheat portion of the cycle, a portion of the heated water above the thermostat 20 level will be transferred to the heating unit A to preheat same and the cool water within the heating unit A will be returned to the storage tank B.

When the preheat portion of the cycle is initiated by the output from thermostat 20, valve 78 in conduit 76 is opened and valve 73 in conduit 74 is closed by the control circuit. Thus, port 80 of tank B is connected to port 68 of unit A. These operations are performed by the control circuit through the use of a series of conventional relays. In addition, valve 58 in conduit 56 normally is in a position at which port 54 in unit A is connected to port 64 in tank B. Pump 72 is actuated by the control circuit to pump water from port 68 in unit A to port 80 in tank B. This causes the heated water near the top of tank B to exit through port 64, travel along conduit 56 and through port 54 into the top of unit A, as the cool water from the bottom of unit A exits from port 68 by means of conduits 70 and 76 and is fed through port 80 into the bottom of tank B. Thus, a portion of the heated water at the top of tank B replaces the cooler water within unit A so as to preheat unit A and raise the temperature of the heating surfaces in reservoir 10 thereby preventing the accumulation of corrosive acids on the heating surfaces in resevoir 10, which would normally be caused by heating a cool surface with a flame from a sulphur containing fuel.

The preheat portion of the cycle continues until thermostat 16, located at the bottom of resevoir 10, senses a water temperature above a preset level. When this occurs, signalling that the heating unit has been filled with heated water from the storage tank B, thermostat 16 provides an output signal to the control circuit which energizes the appropriate relays in the control circuit to deactuate pump 72, close valve 78 in conduit 76 and to actuate the heating unit to begin burning fuel to heat the water in reservoir 10. The heat distribution in the system at this point is shown in FIG. 2C.

As the heating unit is actuated, the direction in which pump 72 pumps is reversed and valve 73 is opened such that conduit 70 is fed by a mixture of water from conduits 82 and 84. Valve 76 is an automatic mixing valve of conventional design which determines the proportions of water from conduits 82 and 84 which are fed to conduit 70. Valve 76 is preferably a thermostatically controlled regulating valve such as the type which are commonly used for the automatic regulation of temperature in commercially available domestic hot water heaters. Such valves are normally fed from both a cold water pipe and a hot water pipe. The valve can be preadjusted to determine the necessary mix to provide the required water temperature. In this instance, the valve is set to mix water from conduits 82 (a cold water pipe) and conduit 84 (a hot water pipe) such that water having a temperature of, for example, 60° C. (140° F.), will be returned from the tank to port 68 in heating unit A. This temperature is considered optimum because it is the lowest temperature which can be utilized and still eliminate the formation of destructive acids which occurs on the resevoir heating surfaces if the surface of the resevoir during actuation thereof is too cold.

After the heating unit A has been actuated, it heats the "mixed water" entering the heating unit at port 68 and delivers hotter water, for example 80° C. (176° F.), which exist from port 54 and enters tank B at port 64. In tank B is formed a temperature front, a "hot water front," which is advancing downwards in the storage tank B until it, after a sufficient amount of time, reaches the level of thermostat 22, as depicted in FIG. 2D. Thermostat 22, until this point in time, has been surrounded by relatively cool water. However, when the "hot water front" reaches the thermostat, the thermostat will generate a signal to the control unit signalling the completion of the actuation portion of the cycle and causing the deactuation of the heating unit. However, pump 72, which has been pumping water from conduit 74 to conduit 70 into port 68 from the beginning of the actuation portion of the cycle, continues to operate in this fashion after the unit is deactuated.

At this point in time it should be noted that accumulator tank B is filled with heated water, except for that portion thereof below the level of thermostat 22, that is, the non-heated water "pocket" 24. Further, resevoir 10 within heating unit A is completely filled with heated water. The cooling portion of the cycle now begins.

Valve 73 in conduit 74 is closed and valve 78 in conduit 76 opened, such that pump 72 pumps water from the non-heated water "pocket" 24 through port 80 into port 68 of unit A. The cool water entering the bottom of unit A causes the heated water within unit A to exit through port 54, travel along conduit 56, through port 64 into the top of accumulator tank B. Thus, cool water from "pocket" 24 is transferred into heating unit A and the heated water in heating unit A is transferred to tank B. In this manner, all of the water heated through the actuation of heating unit A is situated within tank B, and therefore can be utilized effectively and, at the same time, heating unit A is cooled.

Gradually, the entire resevoir 10 will be filled with cool water and there will be no heat loss due to radiation to the surrounding air of convection by means of the chimney draft. When the thermostat 14, located at the top of resevoir 10, senses a water temperature below a given level, thermostat 14 generates a signal to the control circuit which deactuates pump 72 and closes valve 78. At this point, the temperature distribution appears as shown in FIG. 2E and the heating cycle is completed.

After the heating cycle is completed, all of the heated water is situated within tank B and heating unit A contains only non-heated water. Tank B, including "pocket" 24, is virtually filled with heated water. The radiator system will thus be fed with heated water for a relatively long period of time, from 12–24 hours, before the heating cycle need be initiated again.

It should be appreciated that in any fluid containing closed vessel, under certain conditions, a temperature gradient will be set up within the fluid such that the hotter fluid stays at the top and colder fluid stays at the bottom. Further, it should be understood that this temperature gradient will remain in a static condition unless the fluid is externally agitated. Therefore, the hotter portions of the fluid at the top of the vessel will not mix with the cooler portions of the fluid below and fluid of specific relative temperature can be selected by merely drawing water from the vessel at a specified level therein. The operation of the system of the present invention is dependent upon this temperature gradient characteristic which is a well known property of fluids. It is this characteristic which provides the temperature "front" illustrated in FIGS. 2A through 2E which, in effect, provides for automatic control of this system by initiating the various portions of the heating cycle, when required.

All of the valves utilized in the apparatus of the present invention are electrically actuated and, thus, can be controlled by a simple system of relays located in the control circuit or by a thermostat or other sensitive device located in the appropriate location. The relays within the control circuit are energized by the output signals from the thermostats, in a conventional manner. Thus, the control circuit utilized herein is simply a series of conventional relays, operated in a conventional manner and, therefore, not illustrated. Control circuits of this type are known in the art and are routinely designed for this purpose.

The present invention has been described with reference to a pump 72 which is "bidirectional", that is, is capable of pumping in either direction, upon command. Such pumps are commercially available and normally powered by a three-phase electric motor which permits reversing of the pumping direction merely by interchanging two of the three phases. Same is commonly achieved through use of a standard relay which, in this case, is situated within the control circuit. However, if such a reversible circulation pump is not readily available, the system can utilize a pump capable of pumping only in a single direction, that is, from conduits 74 and/or 76, through conduit 70 and into port 68 at the bottom of heating unit A. When a unidirectional pump is utilized, all portions of the heating cycle are identical to those described above except for the preheating portion which, because no pump is available to pump water from the bottom of unit A into the bottom of storage tank B, must be performed in an alternative fashion.

This alternative preheat portion of the cycle is accomplished as follows. When the "cold water front" in the accumulator, which moves upwards in tank B as the heated water is utilized by the radiator system C, passes thermostat 20, the thermostat generates a signal to the control unit, which causes valve 73 in conduit 74 to open (valve 78 in conduit 76 remains closed) and pump 72 to be actuated. Pump 72 provides a flow of heated water from the accumulator tank top, via conduits 84, 74 and 70 into the heating unit bottom through port 68. It should be appreciated that pump 72 is now drawing water mainly through conduit 84 because the temperature of the water at the outlet of mixing valve 76 is being automatically regulated. When this heated water enters heating unit A at the bottom thereof, it will be mixed with the cool water in the resevoir 10. The mixed water leaves resevoir 10 at the top thereof through port 54 and is transferred to the top of tank B through conduit 56. After several minutes, the temperature of the mixed water in resevoir 10 rises to a level at which the risk of accumulation of corrosive acids is eliminated and the unit can then be safely actuated. At this point, thermostat 14, located at the top of resevoir 10, will signal the actuation of the heating unit. Alternatively, the actuation of the heating unit can be initiated by means of an electrical timer, which is started at the beginning of the preheat portion of the heating cycle.

It will be appreciated that this alternate embodiment is somewhat less efficient than the first embodiment described. However, it has been found to function satisfactorily and in addition does not require the use of a reversible pump.

It is also possible to incorporate within the system of the present invention, as described heretofor, a number of optional features. For instance, it is possible to utilize electrical energy to perform the heating function, either alone or in conjunction with the heating unit A described above. This can be achieved through the use of a number of electrical heating coils. An electrically heated accumulator can alone function as the sole heating system, both for heating the house and for heating the domestic hot water. The accumulator can, for that purpose, be provided with one or several electrical heating coils 92, 94, which heat the accumulator water and indirectly the domestic hot water 42. Each of these coils is connected by wires, not shown, to a source of electrical energy. The electrical coils are preferably arranged at different levels within tank B therefore making it possible, because of the effects of the temperature gradient, to heat, when needed, only a part of the water in the accumulator tank. Thus, coil 94 heats only the water above the level thereof and then firstly the water which heats the domestic hot water heater 42. From the point of view of investment, an electrically heated accumulator, which does not require either a chimney or a fuel tank, is a relatively low-cost heating system and may be utilized as a first investment stage for the heating system of a house. A large accumulator tank also makes it possible to store electrical energy in the form of heated water during times, such as nighttime, when electrical energy may be cheaper.

Further, such electrically heated systems may be particularly advantageous in localities where local wind-powered electric generators are available to provide relatively inexpensive electrical energy. However, even with this type of system, it is normally considered to be too expensive to heat entirely with electrical energy. Thus, the most efficient system may be a combination of an electric and fossil burning system wherein the electric portion is used as an auxiliary which provides additional heat energy when wind-powered generators are operational. In FIG. 1 is an electrical coil 90 for locally generated wind-powered energy. Such energy can preferably be made for low voltage electric current, for example, for 24 volts.

Another variation of the system can be achieved through the use of an additional conduit 96 and a three-way valve 98 placed in return conduit 38 of the radiator system C, prior to port 40. Conduit 96 acts as a bypass pipe and connects valve 98 to conduit 70 at a point therein immediately prior to port 68. In this manner, the cold water returning from radiator system C can be routed, via valve 98 and conduit 96, by means of radiator system's circulation pump 34, directly into the bottom of heating unit A. It should be noted that the path back to the bottom of accumulator tank B along conduit 70 is blocked by an additional valve 100 situated in conduit 70 and/or the closing of valves 73 and 78. After the water returning to the bottom of heating unit A in this manner is heated, the heated water enters the top of the accumulator by means of conduit 56, remains near the top of tank B because of the temperature gradient effect, and thereafter leaves the top of the accumulator at port 30, without mixing with the water in tank B below port 30.

This arrangement has several important advantages. One advantage relates to the fact that this configuration acts as a "fail-safe" arrangement should there be a malfunction of the control circuit, pump 72, thermostats and/or valves which normally perform the heating cycle. In the event of a malfunction through the use of bypass conduit 96, the system will behave in a manner identical to a system which does not utilize a storage or accumulator tank, circulation pump 34 being the only movable part of the entire system (excluding the heating unit) which is required for operation. Further, despite the fact that the remainder of the system is inoperable, the water at the top of the accumulator tank is still being heated and thus is still heating the domestic hot water heater 42, located therein. Thus, the use of bypass conduit 96 provides a convenient, inexpensive "fail-safe" system, which can be actuated in the event of a malfunction of the control circuit, valves or pump 72.

The use of bypass conduit 96 has the additional advantage that the homeowner can install the heating system in stages. First, the system without the control circuit and automatic valves, but with bypass conduit 96 can be constructed. Later, the additional automatic energy saving devices can be added to the system, without changing the originally installed portion.

Further, it should be noted that the use of non-heated water "pocket" 24, located at the bottom of the accumulator tank, is not critical to the operation of this system, although the use thereof is quite advantageous. It is possible to drain the accumulator tank from port 80 alone, and thus without the use of port 86 and conduit 82. In this case, the system will still function according to the main principles of the invention. However, the maintenance of the non-heated water "pocket" 24, through the use of outlet conduit 82 during the period when heated water is being transferred into the accumulator tank, considerably increases the efficiency of the system by permitting more effective cooling of the heating unit.

Moreover, the advantageous effect of the non-heated water "pocket" 24 can be increased further if the accumulator tank is provided, in the vicinity of its bottom, with a heat exchanger including coils 48 and 50. As described previously, the cold water entering the system from the supply through conduit 46 passes through coils 48 and 50 prior to entrance into conduit 52, which acts as an inlet to hot water heater 42. With this arrangement, the non-heated water "pocket" 24 will be further cooled by the fresh water entering through conduit 46 and coils 48 and 50. Thus, when the additionally cooled water from non-heated water "pocket" 24 is supplied to unit A during the cooling portion of the cycle, the temperature of the unit will be further decreased because the temperature of the supplied water is lower and therefore, the heating unit A will be cooled to a greater degree. This arrangement is also advantageous because the fresh water from the water supply is preheated in the heat exchanger coils 48 and 50 before it enters the domestic hot water heater 42. The preheating of incoming water decreases the quantity of heat drawn from the heater 42 and increases the capacity of the heater.

A further advantage, when utilizing solar heat, of the additional cooling of the water in the bottom of the accumulator tank by the heat exchanger is that the water can be cooled to quite a low temperature. Thus, the efficiency of a solar heated system will be increased because water of a lower initial temperature is being heated.

Another optional feature of the present invention is same can, without changing or completing of the apparatus, be effectively utilized in conjunction with solar heating apparatus. In this case, three-way valve 100 is positioned so as to connect pump 72 with a conduit 102. Conduit 102 leads to a solar heat collector 104 or a heat exchanger 106 which is heated from the solar heat collector. Thus, water from the bottom of storage tank B is pumped from conduit 102 through a solar heating system consisting of solar heat collector 104 and a heat exchanger 106 and is then connected to return conduit 56 by conduit 108.

It should be noted that such different methods of heating, such as heating with solar heat and heating with a heating unit for fuel burning, could be effected according to the invention with the same apparatus (and both for house heating and domestic hot water heating) only by changing the position of one single valve, the three-way valve 100.

For the most effective utilization of the solar heat, a three-way valve 58 is provided and set such that conduit 56 connects to conduit 62 such that the water returning from the solar heater enters the storage or accumulator tank B at port 66. Thus, the incoming heated water enters the accumulation tank at a point just above thermostat 20 and below the domestic hot water heater.

When utilizing the solar heating, the division of the accumulator tank B by means of the temperature gradient into different temperature zones creates the possibility of automatically taking out most of the useful energy from the solar heated water. For example, if the solar heated water is heated to a relatively low temperature, and enters the accumulator tank through port 66, it will normally have a lower temperature than the water in the zone above thermostat 20. Due to the temperature gradient, the solar heated water will mix with the water in the zone below thermostat 20 and will therefore contribute to the heating of this zone to a more moderate temperature.

On the other hand, if the temperature of the solar heated water is relatively high, this water can enter the accumulator tank at a temperature higher than that of the water in the zone above thermostat 20. In this case, the water will automatically rise into the zone above thermostat 20, thus heating the water in the zone and the hot water heater 42 therein. Thus, solar heated water, whether of high or low temperature, can be utilized effectively in the system of the present invention. The solar heated water can, by way of radiator system C, heat the house or contribute to the heating thereof. Moreover, if the solar heated water is not sufficient for heating of the building or the domestic hot water, the necessary additional heat can "automatically" be supplied either through the use of electrical coil inserts, as described above, or through the use of a fossil fuel burning unit, or both.

Conventional solar heating systems normally require the use of special water storage containers for storing the solar heat energy in the form of heated water. Often, one container is required to supply heated water to heat the house and a second separate container for heating domestic hot water. For economic reasons, these containers normally have a limited capacity and thus they are not able to store all of the available solar heat energy at times when same is readily obtainable. However, when these containers are replaced by the accumulator of the present invention, which is required for other purposes, the solar water heating system is thereby provided with a very large water storage tank which can be utilized to store great quantities of solar heated water when same is available.

It should now be appreciated that the present invention relates to the hot water heating system, particularly suited for use as an individual source of heat for heating a one-family house, or the like, which has extremely high efficiency and which heat source can effectively utilize all forms of heating energy including the burning of fossil fuels, wood, electrical energy or solar heating energy. The apparatus according to the present invention includes a large capacity, highly insulated storage or accumulator tank, which is preferably also provided with a domestic hot water heated located therein. The hot water radiator system is connected to the storage or accumulator tank such that heated water from the tank can be distributed to the hot water radiator system in a conventional way, by a first circulation pump. A second, intermittently operative, circulation pump operably connects the heating unit to the storage or accumulator tank such that the tank is periodically filled with heated water obtained from an oil, gas or solid fuel heating unit or from a solar heating system or from a heat pump device or a heat exchanger connected to a community heating system. The heated water can also be heated directly within the accumulator tank with electric coil heating inserts, if desired. These inserts can in turn be connected to receive electricity from conventional power stations or from local wind powered electric generators.

It should especially be noted, that the invention makes the burning of wood very convenient and effective, as the feeding of the heating unit here can be limited to one or two intensive "blaze-firings" per day, at which the excess heat will be conserved in the accumulator tank. Later the heat can be taken out for automatic heating of the house as convenient and automatic as at oil-heating or electric heating. "Blaze-heating" (with intensive draft) also gives a more favorable combustion than conventional wood burning.

It should also be noted, that the possibility of convenient wood-burning, burning of coal, etc. increases the security of the heating system if there should be lack of oil, electric power, etc.

The method of the present invention includes the step of cooling the heating unit to the vicinity of room temperature by supplying, through the aid of the second circulation pump, certain relatively cool water, which has been retained at the bottom of the accumulator tank for this purpose, to the heating unit such that incoming cooler water causes the heated water within the heating unit to move upwards therein and thereafter be transferred to the top of the accumulator tank. As a result, all of the heated water will, after the cooling portion of the cycle, be contained within the storage tank and thus can be utilized. Further, the heating unit will be cooled to room temperature thereby significantly reducing the heat loss therefrom. As a result, the average efficiency of the system will be very high.

The method of the present invention also includes the step of preheating the heating unit prior to actuation thereof. The preheating portion of the heating cycle is accomplished by transferring heated water, which is retained in the accumulator tank for this purpose, to the heating unit, again by means of the second circulation pump, such that the temperature of the heating unit is increased substantially in order to eliminate the possibility of the accumulation of sulphuric acids against the heating surfaces of the heating unit reservoir. This step therefore extends the useful life of the heating unit.

Further, during the actuation portion of the heating cycle, when the accumulator tank is being filled with hot water from the unit, the unit is supplied with mixed water at a preset temperature such that the relatively cool water entering the bottom of the unit still contains enough sufficient heat to prevent condensation of the sulphuric acids and thus corrosion of the unit walls.

A further characteristic of the present invention is that the accumulator tank is arranged to permit the preservation of a non-heated water "pocket" at the bottom thereof which receives the returning cool water from the radiator system and which water "pocket" is outside the normal water circulation path between the heating unit and the accumulator tank during filling of the accumulator tank with heated water. This water "pocket" can further, according to the present invention, be cooled down to a lower temperature by the aid of the incoming fresh water from the water supply, before same enters the domestic hot water heater of the system.

While only a limited number of embodiments of the present invention have been disclosed herein for purposes of illustration, it is obvious that many modifications and variations could be made thereto. It is intended to cover all of these variations and modifications which fall within the scope of the present invention as defined by the following claims.

I claim:

1. Apparatus for conservation of energy in a hot water heating system of the type comprising a water heating unit and a radiator, the apparatus comprising first and second ports located near the top and bottom of the unit, respectively; a water storage tank having a capacity greater than the capacity of the unit; third, fourth and fifth ports located near the top, bottom, and a point spaced from the bottom of the tank, respectively; a first conduit operatively connecting said first and third ports, a second conduit operatively connected to said fifth port, a third conduit operatively connected to said fourth port, valve means operatively connected to said second and third conduits for connecting a selected one of said second and third conduits to said second port, pump means effective, when actuated, to pump water between said unit and said tank and means for connecting said tank to said radiator.

2. The apparatus of claim 1, wherein said fifth port is located within said tank at a level above a quantity of water therein approximately equal to or greater than the capacity of the unit.

3. The apparatus of claim 1, further comprising first temperature sensing means located within said tank at a level therein below a volume of water greater than the capacity of the unit, said first temperature sensing means being effective to cause actuation of said valve means to connect said third conduit to said second port when the water temperature sensed thereby falls below a given temperature level.

4. The apparatus of claim 3, wherein said first temperature sensing means is effective to cause actuation of said pump means to pump water in a direction from said third port to said first port.

5. The apparatus of claim 1, further comprising second temperature sensing means located in said unit in the vicinity of said second port and effective, when water at a temperature above a second given temperature level is sensed thereby, to cause actuation of said valve means to connect said second conduit to said second port.

6. The apparatus of claim 5, wherein said second temperature sensing means is effective, when water at a temperature above a second given temperature level is sensed thereby, to cause actuation of said unit.

7. The apparatus of claim 5, wherein said second temperature sensing means is effective, when water at a temperature above a second given temperature level is sensed thereby, to cause said pump means to pump water in a direction from said first port to said third port.

8. The apparatus of claim 1, further comprising third temperature sensing means, said third temperature sensing means being located in said tank in the vicinity of said fifth port and being effective, when water above a third given temperature level is sensed thereby, to deactuate said unit.

9. The apparatus of claim 8, wherein said third temperature sensing means is effective, when water above a third temperature level is sensed thereby, to actuate said valve means to connect said third conduit to said second port.

10. The apparatus of claim 8, wherein said third temperature sensing means is effective, when water above a third given temperature level is sensed thereby, to cause said pump means to pump water in a direction from said first port to said third port.

11. The apparatus of claim 10, further comprising fourth temperature sensing means located in said unit in the vicinity of said first port and effective, when a temperature below a fourth given level is sensed thereby, to deactuate said pump means.

12. The apparatus of claim 1, further comprising an auxiliary heating unit operably connected to said tank in parallel with said heating unit.

13. The apparatus of claim 1, further comprising a sixth port located in said tank in the vicinity of the top thereof and wherein said second conduit comprises an auxiliary section operably connected to said sixth port.

14. The apparatus of claim 13, further comprising a thermostatically controlled mixing valve located at the junction between said auxiliary and main sections of said second conduit.

* * * * *